US011702718B2

(12) United States Patent
Krech et al.

(10) Patent No.: US 11,702,718 B2
(45) Date of Patent: Jul. 18, 2023

(54) METHOD OF MAKING MAGNETICALLY SOFT INTERMEDIATE PRODUCT

(71) Applicants: Dieter Krech, Hagen (DE); Thomas Kloss, Hamm (DE)

(72) Inventors: Dieter Krech, Hagen (DE); Thomas Kloss, Hamm (DE)

(73) Assignee: BILSTEIN GMBH & CO. KG, Hagen (DE)

( * ) Notice: Subject to any disclaimer, the term of this patent is extended or adjusted under 35 U.S.C. 154(b) by 306 days.

(21) Appl. No.: 17/195,008

(22) Filed: Mar. 8, 2021

(65) Prior Publication Data

US 2022/0282354 A1 Sep. 8, 2022

(51) Int. Cl.

| | |
|---|---|
| ***C21D 9/52*** | (2006.01) |
| ***C21D 8/02*** | (2006.01) |
| ***H01F 1/147*** | (2006.01) |

(52) U.S. Cl.

CPC ..... *C21D 9/52* (2013.01); *C21D 8/0205* (2013.01); *C21D 8/0226* (2013.01); *C21D 8/0236* (2013.01); *H01F 1/147* (2013.01)

(58) Field of Classification Search

None

See application file for complete search history.

(56) References Cited

FOREIGN PATENT DOCUMENTS

WO WO-2020125094 A1 * 6/2020 ..... B22D 11/0611

* cited by examiner

*Primary Examiner* — Anthony M Liang

(74) *Attorney, Agent, or Firm* — Andrew Wilford

(57) ABSTRACT

A method of making a soft magnetic intermediate product of metal with particularly good magnetization behavior, the method comprising the following method steps:

production or provision of a metallic, rollable blank of a metallic product, preliminary rolling of the metallic blank with a defined degree of deformation to an intermediate thickness, the degree of deformation being matched to a critical or postcritical degree of rolling to be observed during subsequent rolling, heat treatment of the prerolled blank, preferably annealing of the prerolled blank, rolling of the blank with a critical or postcritical degree of rolling to a final thickness and subsequent annealing to set a defined grain size and finishing of the intermediate product.

13 Claims, 2 Drawing Sheets

Table 1

Equal-field measurements Hc, Br, Js, μ; MAGNET-PHYSIK Warmband St 24 SA7 HOESCH-HOHENLIMBURG, Tab. 2017

| Deformation | ε - 11% | ε - 15% | ε - 20% | ε - 25 |
|---|---|---|---|---|
| Annealing 710°C 16 h | | | | |
| Condition | A* | A* | A* | A* |
| Grain size | ASTM | ASTM | ASTM | ASTM |
| Benchmarks | 1 — 2 | 3 — 4 | 4 — 5 | 5 — 6 |
| Rp 0.2 [i\IPa] max. | 140 | 150 | 180 | 200 |
| Rm [MPa] max. | 300 | 300 | 310 | 310 |
| A80 [%] min. | 30 | 32 | 34 | 36 |

Fig. 2

METHOD OF MAKING MAGNETICALLY SOFT INTERMEDIATE PRODUCT

The invention relates to a method of making a soft magnetic intermediate product made of metal with particularly good magnetization behavior.

Soft magnetic intermediate products are known in the art as electrical steel.

Soft magnetic materials are to be understood as materials that can be easily magnetized and demagnetized, in particular under the influence of external electrical fields, current-carrying conductors and magnetic fields, so that electrical energy can be optimally used through their use in electrical systems.

The soft magnetic intermediate product is further processed into end products that are used, for example, in electrical engineering. Depending on the application and requirements, an intermediate product with suitable soft magnetic properties is selected and used.

If, for example, the magnetic flux is not fixed in a certain direction for the purpose of application, but it is necessary that good magnetic properties are given in all directions, an intermediate product with isotropic properties is used. This is also known as grain nonoriented electrical steel and is used, for example, in generators, electric motors or relays.

Such grain nonoriented materials are considered below.

These and other properties, such as permeability, remanence, flux density and saturation as well as coercive field strength, describe the quality of the soft magnetic properties of materials. These properties can and must be matched to the application of the product.

In the prior art, a semifinished product, preferably hot-rolled steel, is used as the starting product to produce an electrical steel strip with such desired properties. In the case of so-called grain nonoriented and finally annealed electrical steel grades, after the hot strip has been pickled, cold rolling is carried out in several rolling passes to the desired final thickness and subsequent final annealing such that the rolled structure recrystallizes, the carbon content is set very low and coarse grain formation is effected about so that the material has very low magnetizability. The intermediate product (cold strip) is then processed into end products, with the end products being punched out of the cold strip, for example, or cut out by laser cutting. During this further processing, deformation of the material must absolutely be avoided, since deformation results in dislocations in the structure that would significantly impair the magnetizability of the material and lead to an unsatisfactory end product.

Another possibility for making an electrical steel strip with the desired properties is that the hot strip made of steel is cold-rolled after pickling, annealed for recrystallization and then cold-rolled with a low degree of deformation (critical deformation) in order to enhance targeted grain growth and thereby the magnetizability of the material. End products, for example stamped and bent parts or deep-drawn parts, can then be manufactured from this intermediate product, with the end products having to be subjected to a special annealing method after they have been completed in order, for example, to eliminate the dislocations introduced into the material structure during forming and to provide a product with optimal soft magnetic properties.

Such electrical steel is referred to as grain nonoriented, unannealed electrical steel.

The subsequent special annealing of the end products is complex and expensive, since each individual part has to be fed into the annealing method.

The object of the invention is to create an economically feasible method with which the soft magnetic and mechanical properties of an intermediate product can be set in a targeted manner, with the properties being determined in particular with regard to further processing of the intermediate product, so that no complex heat treatment is required for end products produced of the intermediate product and an end product with good soft magnetic properties is produced.

In addition, methods covers providing is alternative solutions for making intermediate products with particularly good soft magnetic properties.

To attain this object, the invention proposes a method according to claim 1 in that:

- A rollable metallic blank is produced or provided as the starting product. The blank can for example consist of ferritic steel or another metallic material and has isotropic properties.
- The metallic blank is first rolled, the rough rolling being carried out to an intermediate thickness. The degree of deformation during prerolling is matched to a critical or postcritical degree of rolling to be set in a subsequent rolling, so that only a slight deformation of the material in the critical or postcritical deformation area with a low degree of rolling is necessary during subsequent rolling to the final thickness. The degree of deformation during prerolling to the intermediate thickness is therefore dependent on the critical or postcritical degree of rolling during rolling to the final thickness.
- After prerolling, the blank is heat-treated, preferably annealed in a recrystallizing manner.
- This is followed by rolling the blank to the desired final thickness with the critical or postcritical degree of rolling, and
- Further annealing immediately following this rolling. By rolling with the critical or postcritical degree of rolling and the subsequent annealing, grain growth is brought about in the metallic structure, which enables easier and faster magnetization and demagnetization of the material.

When a material is formed by rolling with a degree of rolling that is less than the critical degree of rolling, there is initially no or at least no significant grain growth in the structure. Only when the critical degree of rolling is reached is grain growth brought about in the structure, with the maximum grain size being reached during forming with the critical degree of rolling. If the degree of rolling is greater than the critical degree of rolling (postcritical degree of rolling), the grain size decreases progressively as the degree of rolling increases. The degree of rolling is selected in such a way that grain growth is provoked in the structure, that is at least a critical or postcritical degree of rolling, with the grain size and the magnetic properties being able to be set in a defined manner via the degree of rolling. The lower the degree of rolling selected, the larger the grains created in the structure and the better the magnetization properties, that is the easier and faster the material can be magnetized. At the same time, however, the mechanical properties of the material deteriorate with increasing grain size.

The grain size and the associated magnetic and mechanical properties can and should therefore be set in a targeted manner via the critical or postcritical degree of rolling and adapted to the respective later application of the material, so that a suitable intermediate product can be provided specifically for the respective application.

The soft magnetic properties that are introduced into the material when the method is carried out enable the intermediate product to be further processed, also by forming, for example deep-drawing or bending, into end products with particularly good soft magnetic properties, without the end products having to be subjected to a subsequent special annealing. This eliminates the need for time-consuming and expensive posttreatment of the individual products.

The method can be used to produce and provide various intermediate products with particularly good soft magnetic properties, for example strips, wires or similar semifinished products made of metal, which are then formed into end products.

It is preferably provided that the blank is a hot strip made from a ferritic (or unalloyed) steel.

It is preferably provided that the blank is prerolled with a degree of deformation of 30-80% during prerolling.

A degree of deformation of this order of magnitude is necessary, for example, when machining a hot strip made of steel, so that during subsequent rolling with a critical or postcritical degree of rolling, deformation of the material into the critical or postcritical area can be ensured.

A hot strip made of steel, which is to be processed according to the method, can have a thickness of up to 50 mm.

If a different blank or material is used, the degree of deformation is adapted to the respective material-specific critical or postcritical degree of rolling.

It is preferably provided here that the annealing of the prerolled blank takes place at a temperature of 550° C.-700° C., the annealing preferably being carried out for up to 50 hours.

As a result, the structure is recrystallized after roughing.

Furthermore, it is preferably provided that the critical or postcritical degree of rolling is between 8 and 25%, preferably between 9 and 15%, such that the annealing immediately following the rolling with the critical or postcritical degree of rolling is at a temperature of up to 710° C. and takes place and the annealing takes place over a period of up to 80 hours.

By prerolling with a degree of rolling within the specified limits and subsequent annealing, the grain sizes of an unalloyed steel material can be set variably and adapted to the subsequent intended use of the intermediate product. Depending on the selected material, the critical and thus also the postcritical degree of rolling lies in the specified range, and different grain sizes can be set depending on the degree of rolling. In the case of steel (alloyed or unalloyed), grain sizes from ASTM 1 to 6 can be set, so that the grain size decreases with increasing deformation.

If another material is used, its material-specific critical or postcritical degree of rolling is to be determined and used for rolling.

It is preferably provided that an upstream heat treatment, preferably annealing, is carried out before the prerolling of the blank, and it is preferably provided that the upstream annealing be carried out at a temperature between 650 and 800° C. and preferably carried out over a period of up to 60 hours.

The upstream heat treatment, preferably annealing, serves to prepare the metallic material of the blank for its processing and to bring the structure of the blank into an improved initial state.

In the case of blanks made of a ferritic steel, the upstream heat treatment causes, for example, a change in carbon content. The carbon, which was randomly distributed in the structure before heat treatment, is deposited on the grain boundaries as a result of the heat treatment.

The upstream heat treatment can additionally improve the soft magnetic properties of the intermediate product, and an intermediate product of even better quality can be provided.

Provision is preferably made for the blank to be finish-rolled before completion and after the final heat treatment, it being preferably provided that finish-rolling takes place with a degree of deformation between 0.1 and 2%.

This allows the exact thickness of the material as well as the flatness and the quality of its surface to be set.

In the drawing, an embodiment of the method according to the invention is shown and described in more detail below.

Therein:

FIG. 2 is a table of the magnetic and mechanical properties of a carbon steel after completing the method with different degrees of rolling.

FIG. 1 shows schematically the sequence of a method of making a metallic soft magnetic intermediate product with particularly good magnetization behavior.

Figure 1:
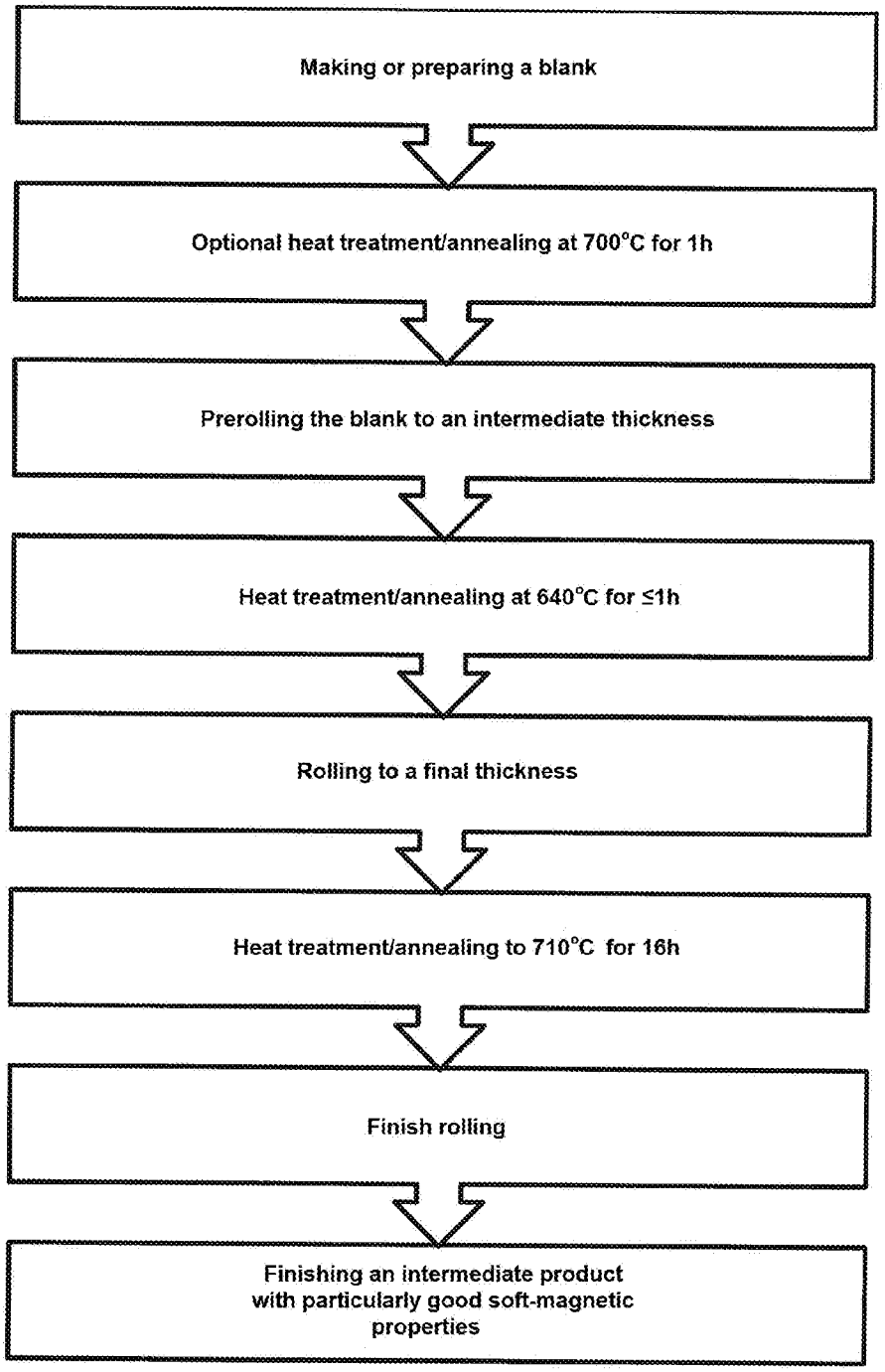
FIG. 1 shows a schematic sequence of the method.

The method is used to produce an intermediate product in the form of a cold strip made of steel.

For this purpose, a metallic, rollable blank made of steel is produced or provided as the starting product, namely a semifinished product, preferably hot strip made of an unalloyed steel whose material has isotropic properties.

The hot strip is first prerolled, the prerolling being carried out to an intermediate thickness. The degree of deformation during prerolling is between 30 and 80% and is matched to a critical or postcritical degree of rolling to be set during subsequent rolling to the final thickness, so that when rolling to the final thickness only a slight deformation in the critical or postcritical deformation area of the material with a small amount of rolling is necessary. The degree of deformation during prerolling to the intermediate thickness is therefore dependent on the critical or postcritical degree of rolling during rolling to the final thickness.

The prerolled blank is then heat-treated, with annealing preferably being carried out at a temperature between 550 and 700° C. for a period of up to 50 hours.

After annealing, rolling takes place, with the blank being rolled to its desired final thickness with the critical or postcritical degree of rolling, and further annealing connected to rolling at a temperature of up to 710° C. over a period of up to 80 hours. By rolling with the critical or postcritical degree of rolling and the subsequent annealing, grain growth is brought about in the metallic structure, which enables easier and faster magnetization and demagnetization of the material.

The deformation must be carried out with at least a critical degree of rolling, since if the material is deformed by rolling with a degree of rolling that is less than the critical degree of rolling, no or at least no significant grain growth occurs in the structure. Only when the deformation has reached the critical degree of rolling is a clear grain growth brought about in the structure, with the maximum grain size being set during deformation with the critical degree of rolling. If the degree of rolling is greater than the critical degree of rolling (postcritical degree of rolling), the grain size decreases again, the grain size becoming smaller as the postcritical degree of rolling increases. In this way, at least one critical or a postcritical degree of rolling is set, it being possible to set the grain size in a defined manner via the degree of rolling and, moreover, the magnetic properties. In the example shown, the degree of rolling [ε] is between 11 and 25%. The results obtained with regard to the magnetic and mechanical properties, which are achieved by forming the material with such degrees of rolling, are shown in the table in FIG. 2. The lower the degree of rolling selected, the larger the created grains in the structure and the better the magnetization properties, that is the easier and faster the material can be magnetized. At the same time, however, the mechanical properties of the material deteriorate with increasing grain size.

The grain size and the associated magnetic and mechanical properties are therefore set specifically via the critical or postcritical degree of rolling and adapted to the respective later application of the material, so that a suitable intermediate product can be provided specifically for the respective application.

The soft magnetic properties that are introduced into the material in this way enable the intermediate product to be further processed, also by forming, for example deep-drawing or bending, into end products with particularly good soft magnetic properties, without the end products having to be subjected to a subsequent special annealing. This eliminates the need for time-consuming and expensive posttreatment of the individual products.

After rolling and subsequent annealing, the blank is finish rolled with a degree of deformation of for example 0.7%. This sets the exact thickness of the material as well as the flatness and the quality of the surface.

In addition, there is the possibility of initially supplying the blank to annealing before roughing in order to prepare the material for the subsequent method steps and to bring the structure to an improved initial state. This annealing is preferably carried out at a temperature between 650 and 800° C.

The annealing results in a change in the carbon content in the structure. Before the heat treatment, the carbon is randomly distributed in the structure and is deposited on the grain boundaries due to the annealing. As a result, the carbon does not later negatively hinder the magnetization of the material and the soft magnetic properties of the intermediate product can be improved. An intermediate product of particularly good quality can be provided.

After the upstream heat treatment, the further method steps are carried out.

The method makes it possible to provide an intermediate product with particularly good soft magnetic properties, which can be set in such a way that a subsequent reshaping of the material, for example into deep-drawn or stamped-bent parts with particularly good soft magnetic properties, is possible without affecting the end products must then be subjected to a special annealing or comparable heat treatment.

The invention is not restricted to the embodiment, but is variable in many ways within the scope of the disclosure.

All individual and combination features disclosed in the description and/or drawing are regarded as essential to the invention.

The invention claimed is:

1. A method of making a soft, metallic, and magnetic intermediate product, the method comprising the steps of:

manufacturing or providing a metallic, rollable blank, prerolling the metallic blank with a defined degree of deformation to an intermediate thickness, the defined degree of deformation being matched to a critical or postcritical degree of rolling to be maintained during subsequent rolling, heat treating the prerolled blank, rolling the heat-treated blank with a critical or postcritical degree of rolling to a final thickness, thereafter annealing the rolled blank to set a defined grain size therein, and finishing the the annealed blank.

2. The method according to claim 1, wherein the blank is a hot strip made of a ferritic or unalloyed steel.

3. The method according to claim 1, wherein the blank is prerolled by rough rolling with a degree of deformation of 30-80%.

4. The method according to claim 1, wherein heat treating of the prerolled blank takes place at a temperature of 550° C.-700° C.

5. The method according to claim 4, wherein the annealing is carried out for up to 50 hours.

6. The method according to claim 1, wherein the critical degree of rolling is between 8 and 25%.

7. The method according to claim 1, wherein the annealing following the rolling with the critical degree of rolling takes place at a temperature of up to 710° C.

8. The method according to claim 7, wherein the annealing following the rolling with the critical degree of rolling takes place over a period of up to 80 hours.

9. The method according to claim 1, further comprising the step of:

carrying out an upstream heat treatment before the prerolling of the blank.

10. The method according to claim 9, wherein the upstream heat treatment takes place at a temperature between 650° C. and 800° C.

11. The method according to claim 9, wherein the upstream heat treatment is carried out over a period of up to 60 hours.

12. The method according to claim 1, the finishing comprises the step of:

finish rolling the blank.

13. The method according to claim 12, wherein the finish rolling takes place with a degree of deformation between 0.1 and 2%.

* * * * *